US011085275B2

(12) United States Patent
Ceccon De Azevedo et al.

(10) Patent No.: US 11,085,275 B2
(45) Date of Patent: Aug. 10, 2021

(54) SHARED ACTUATION SYSTEM

(71) Applicant: FMC TECHNOLOGIES DO BRASIL LTDA, Rio de Janeiro (BR)

(72) Inventors: Alex Ceccon De Azevedo, Rio de Janeiro (BR); Leonardo De Araujo Bernardo, Rio de Janeiro (BR); Alan Zaragoza Labes, Rio de Janeiro (BR)

(73) Assignee: FMC TECHNOLOGIES DO BRASIL LTDA, Rio de Janeiro (BR)

( * ) Notice: Subject to any disclaimer, the term of this patent is extended or adjusted under 35 U.S.C. 154(b) by 0 days.

(21) Appl. No.: 15/323,343

(22) PCT Filed: Jun. 30, 2015

(86) PCT No.: PCT/BR2015/050084
§ 371 (c)(1),
(2) Date: Dec. 30, 2016

(87) PCT Pub. No.: WO2016/000057
PCT Pub. Date: Jan. 7, 2016

(65) Prior Publication Data

US 2017/0159410 A1 Jun. 8, 2017

(30) Foreign Application Priority Data

Jul. 1, 2014 (BR) ..... 1020140163646

(51) Int. Cl.
*E21B 41/04* (2006.01)
*E21B 41/10* (2006.01)
*E21B 41/00* (2006.01)

(52) U.S. Cl.
CPC ..... *E21B 41/04* (2013.01); *E21B 41/0007* (2013.01); *E21B 41/10* (2013.01)

(58) Field of Classification Search
CPC ..... E21B 41/04; E21B 41/0007
(Continued)

(56) References Cited

U.S. PATENT DOCUMENTS 3,381,485 A 5/1968 Cooks et al.
4,625,805 A 12/1986 Ladecky
(Continued)

FOREIGN PATENT DOCUMENTS

EP 1070573 A1 1/2001
EP 2520484 A2 11/2012
(Continued)

OTHER PUBLICATIONS

International Search Report issued in corresponding application No. PCT/BR2015/050084 dated Dec. 4, 2015 (9 pages).
(Continued)

*Primary Examiner* — Matthew R Buck
*Assistant Examiner* — Patrick F Lambe
(74) *Attorney, Agent, or Firm* — Osha Bergman Watanabe & Burton LLP

(57) ABSTRACT

The present invention refers to a shared actuation system to place tools on any subsea valve interface on an oil production station located in a subsea structure, such as a manifold. The system comprises a connection device for connection to the subsea structure, attached to the connection device at least one structural element, all connected to each other through rotary joints, providing at least two degrees of freedom for a distal end of the structure elements where an actuation tool is positioned, for interaction with the valve interfaces on the subsea structure, where the structural elements further is connected to a sail element.

8 Claims, 3 Drawing Sheets

(58) Field of Classification Search
USPC ..... 166/338
See application file for complete search history.

(56) References Cited

U.S. PATENT DOCUMENTS

| | | | | |
|---|---|---|---|---|
| 6,644,410 | B1 | 11/2003 | Lindsey-Curran et al. | |
| 2008/0109108 | A1 | 5/2008 | Lawson | |
| 2009/0050328 | A1 | 2/2009 | Bath et al. | |
| 2010/0042357 | A1 | 2/2010 | McCoy, Jr. et al. | |
| 2015/0204167 | A1 * | 7/2015 | Skeels ..... | E21B 33/038 166/344 |

FOREIGN PATENT DOCUMENTS

| | | | | |
|---|---|---|---|---|
| GB | 2212538 | A * | 7/1989 | ..... B25J 5/00 |
| GB | 2212538 | A | 7/1989 | |
| WO | 86/00353 | A1 | 1/1986 | |
| WO | 87/07232 | A1 | 12/1987 | |
| WO | WO1987007232 | A1 * | 12/1987 | |

OTHER PUBLICATIONS

Written Opinion of the International Searching Authority issued in corresponding application No. PCT/BR2015/050084 dated Dec. 4, 2015 (10 pages).

International Preliminary Report on Patentability issued in corresponding application No. PCT/BR2015/050084 dated Sep. 30, 2016 (22 pages).

* cited by examiner

SHARED ACTUATION SYSTEM

FIELD OF THE INVENTION

The present invention refers to a shared actuation system to place tools on any submerged valve interface on an oil production station located in a structure of a subsea equipment as for example a manifold type.

BACKGROUND OF THE INVENTION

Many remote actuation systems of subsea valves applied in subsea manifolds are known. One example comprises a generally-electro-hydraulic control system to control generally-hydraulic actuators for each valve. Said control system consists of a subsea control module, a hydraulic power unit and the umbilical. The umbilical is responsible to deliver the power, hydraulic fluid and to transmit the controls signals to the subsea control unit. The subsea control module (SCM) receives the signals from the master control unit (MCS) located at the surface. The SCM is responsible to send the signals to open and closing of the valves through the hydraulic fluid coming from the Hydraulic Power Unit located at surface.

A drawback found in this technique is the weight and dimensions of the final subsea manifolds, which result in increased weight and dimensions of the subsea manifold with the increased number of valves along with the increased work and depth pressure. Another drawback of the technique is the extensive time required for the installation of the piping of the electro-hydraulic control system, which implies an increase in the period of manufacture of the manifolds, plus the cost associated with the necessary equipment like hydraulic actuators, the subsea control module, the electro-hydraulic umbilical and the hydraulic power unit.

An alternative to the technique described above, but less frequently used nowadays, is the use of subsea electric actuators. According to said technique, each manifold valve to be remotely controlled has an electric actuator connected to an electrical control system. Said electrical control system consists of a power grid in the manifold to supply power and signal to the actuators connected to an umbilical with electrical lead connecting the subsea system to an electric and control power unit located on the surface.

An advantage presented by this second technique is the reduction of the period to manufacture the manifold, since the installation of the hydraulic control system in the manifold is not necessary. By contrast, in spite of reducing the system cost, since it eliminates the cost of the hydraulic umbilical, the surface power unit and the subsea control module, the use of an electric actuator by valve makes this system much more expensive than the first one, since such actuators are expensive equipment in the market.

A third known alternative consists of a shared actuation system (SAC). Said system consists of the use of a structure located along one side of the manifold with an actuation tool that is displaced by a mechanism to the interface of each valve at the time of their actuation. In this alternative, the manifold contains only mechanical valves without remote actuation, and all the actuation system is realized by the SAC. The mechanism, which displaces the actuation tool does it through a Cartesian positioning system moved by hydraulic pistons on rails and operated by an electro-hydraulic control system. The position of the actuation tool is checked by position and flow sensors located in the SAC. The actuation tool consists of a device that enables the interface with the valve stem and applies torque through a hydraulic power system. The number of turns applied is verified through the flow-through in the tool. The electro-hydraulic control system comprises a hydraulic pipe connected to the SAC, an subsea electro-hydraulic control module, a SAC compensation system, an umbilical containing hoses and electrical lead to supply fluid, electrical power and signals, connected to the hydraulic pressure unit on the surface and the electrical and control power unit also located on the surface. The SAC can be installed separately and removed from the manifold for repair if necessary. As it is known by those skilled in the art, this third alternative was used only once in the industry for remote actuation of valves.

Despite this third alternative technique aims to minimize the drawbacks of the first and second techniques through a shared actuation system, the costs of the subsea control module, hydraulic umbilical and surface hydraulic power unit are still present. Another drawback presented by this technique consists of the constructive characteristic of the Cartesian positioning of the system, which requires that the equipment has the same dimensions as the plane where the valves are contained. Said requirement makes the equipment heavy and difficult to be installed and removed in case of failure or maintenance. In addition, the large size of the equipment compromises the integration of shared actuation system with the manifold, making it complex and difficult or almost impossible to promote interchangeability.

Other control systems of subsea devices are described in the prior art. Patent application US 2010042357 discloses a system and method for determining the position of an articulated member relative to a plane, and said system may be adapted for subsea use. Patent application US 2008109108 discloses a control system for a manipulator arm for use in subsea remotely operated vehicles (ROVs). U.S. Pat. No. 6,644,410 discloses a modular control system composed of independent segments for use in subsea equipment, including manifolds. Patent application US 2009050328 discloses a system for subsea installation of insulation on flowlines, connectors and other subsea equipment from a remotely operated vehicle. Patent application EP 1070573 describes a system for the application and monitoring of subsea installations, such as manifolds valves. However, none of the abovementioned documents discloses the subject matter of the present invention, which advantageously solves the drawbacks of the remote actuation systems of subsea valves described by the prior art to date, namely, excess weight and large size of the system, high costs, long manufacture period, and restrictions on the repair and replacement of parts and the equipment itself.

It is therefore the object of the present invention to eliminate or at least minimize said problems of the prior art using a system comprising an articulated mechanism capable of positioning on any manifold valve interface a tool for its operation.

According to the invention there is provided a shared actuation system for positioning tools on any valve interface submerged on an oil production station located in subsea structure. The shared actuation system comprises an actuation tool which displaces through the rotary joints and structural elements which have a hydrodynamic profile and connect to a sail element suitable for movement in the subsea environment.

The actuation tool is for interaction with valve interfaces and may for instance be a rotary tool for opening and closing of valves. The actuation tool may be positioned at a distal part of an assembly of structural elements, in the form of arms, connected to each other by rotary joints. The degree of freedom for the part with the tool is thereby dependent on the number of arms and joints and the type of joints in the assembly. The structural elements, or at least one of the structural elements have a hydrodynamic profile in that when it is moved through water, the forward edge of the element moving facing the water when moved through water has a relative thinner cross section compared with the trailing part of the same structural element. As one longitudinal structural element may normally be operated in one plane relative the structural element it is attached to, rotating around one axis in the rotary joint which is perpendicular to the longitudinal direction of the structural element, the structural element may be formed with a relative thinner cross section at two forward edges opposite each other compared with the trailing part of the structural element in the movement directions. The distal structural element may in one configuration together with the additional other structural elements and the joints, be arranged to be rotational about two parallel axis and possibly also one axis perpendicular to these two axis. These are just examples or possible degrees of freedom of the different elements and how they then may be made with a hydrodynamic profile. The sail element may be connected to the assembly of structural elements and joints, in an opposite position compared with the actuation tool. The sail element has one function of providing stability to the assembly of structural elements and joints, as this is rotated and extended to interact with different valve interfaces. The sail element holds two units (one on-line and the other one spare) which contain the electronic elements as the robotic motion unit and the robotic drive unit responsible for the autonomous movement of the arm.

According to another aspect of the invention the shared actuation system may comprise a single interface with the subsea equipment (e.g. a manifold) from a single element on the operating system and a single element in the equipment. In one embodiment that said element in the actuation system is a pin and the element in the manifold is a funnel. It is also possible to have different single interfaces, or to have the funnel and pin arranged on the opposite parts of the operating system and the equipment respectively.

According to another aspect of the invention the said rotary joints are elements sealed to the external environment and offset by lubricating oil that protects itself in the subsea environment. This meaning that the movable part of the rotary joints are not exposed to the surroundings. The joints may for instance be arranged within a flexible housing which is attached to the two parts connected to the joint. In another embodiment the housing may not be flexible but arranged such that it protects the joint. The housing may also be filled with a lubricant and this may be put under pressure preventing the surrounding water to enter the housing.

According to another aspect of the invention at least a part of the structural elements may comprise composite materials in its structural elements. Another possibility is to have the system provided with floating elements integral and or attached to the system.

According to yet another aspect the system is configured such that the submerged weight of the unit is on average less than 100 pounds.

According to another aspect there is provided a shared actuation system for positioning a tool relative to several valve interfaces on a subsea structure as a manifold. According to the invention it comprises a connection device for connection to the subsea structure. During normal operation the shared actuation system is attached to the subsea structure. It may be arranged to be separately retrievable from the subsea structure and may have retrieving means in for instance an attachment device for an ROV or line deployed from vessel. Attached to the connection device there is at least one structural element, possibly two, three or four structural elements, all connected to each other through rotary joints, providing at least two degrees of freedom for a distal end of the structure elements where an actuation tool is positioned. The assembly of structural elements and rotary joints may for instance provide tree degrees of freedom for the distal end of the assembly. The tool is there for interaction with the valve interfaces or other equipment on the subsea structure. The structural elements are further connected to a sail element. The sail element is designed to hold the robotic motion and drive units responsible to control the movements of the robotic arm and compensate the weight. The structural elements assembled may be of different kinds and or some may be similar. In one possible embodiment the structural elements may be as a post rotating around its own axis, a joining element arranged pivoting relative the post about an axis perpendicular to the rotation axis of the post, and an arm element attached to the joining element forming a distal element in the assembly. The arm element being rotational attached to the joining element with a rotation axis mainly parallel with the rotation axis of the post.

According to another aspect the connection device may comprise a single interface comprising a pin or funnel for interaction with complimentary elements on the subsea structure. The single interface may have other elements than pin and funnel and or may also have several of these. There may in one instance also only be a pin and a funnel. These may be provided with internal guiding providing a given relative position of the elements when connected. There may alternatively for instance be a short and long pin, for guiding the interface together with the system on the subsea structure.

According to an aspect of the invention the rotary joints may be sealed to the external environment, thereby protecting the moving surfaces of the joints from the surrounding water. This may be done in several ways as mentioned above. In another aspect at least a part of the structural elements may be made of composite materials as mentioned above. According to another aspect the system may comprise floating elements integral and or attached to the system.

According to another aspect the system comprises a control system arranged to operate the arm. The operation consists on moving the rotary joints to position the tool relative the desired valve interface for interaction with this. A control system may be provided integral with the system attached to the structural elements of the system. The system operates in an autonomous way, knowing the movements necessary to reach the desired position. This control system is provided from the sail element, which holds the electronic system necessary to operate the system. The electronic system is composed by the robotic drive unit and the robotic motion unit. The robotic motion unit has an electronic motion controller board, system powers supply boards, with line couplers and memories. The robotic drive unit has the motor drive and power supply. The control system may comprise a communication unit for communication with a remote located operator. This may be done with a line or wireless. The rotary joints are operated by the signal coming from the electronic unit and a remote signal from a control unit arranged on the subsea structure or a transmitter or communication unit arranged on the subsea structure receiving operating signals from a remote operator.

According to an aspect of the invention there may be three main structural elements, connected by rotary joints and the sail element is connected to the structural elements in a position opposite the actuation tool.

According to the invention there is also provided a subsea system, comprising a subsea structure and a shared actuation system according to what is explained above where the shared actuation system is connected to the subsea structure in one fixed position, and there being a rotary joint between the connection device and the structural elements and there being at least two structural elements connected by a rotary joint, arranged such that the tool at the distal end of the structural elements may be operated to interact with several valve interfaces arranged around this fixed position and at different radial distances from the fixed position.

BRIEF DESCRIPTION OF THE DRAWINGS

The present invention will hereinafter be described with reference to the accompanying drawings, which represent a schematic and non-limiting form of its scope.

DETAILED DESCRIPTION OF THE INVENTION

Figure 1:
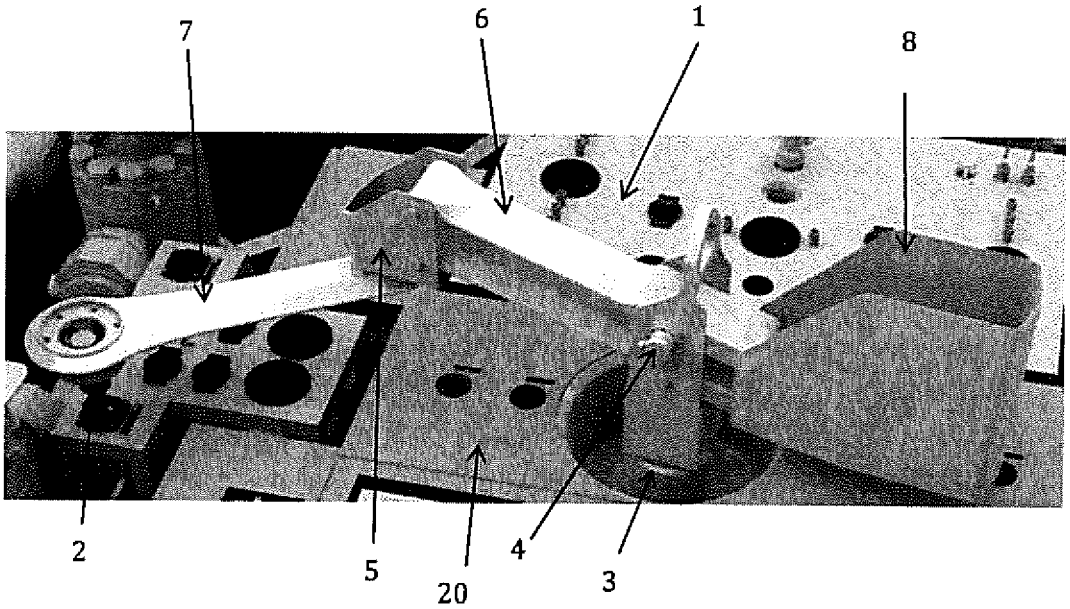
FIG. 1—shared actuation system according to the present invention.
Figure 2:
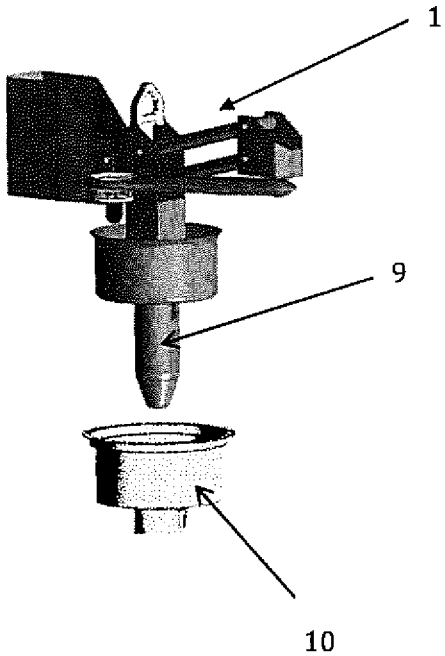
FIG. 2—schematic view of the shared actuation system interface with a manifold according to the present invention.
Figure 3:
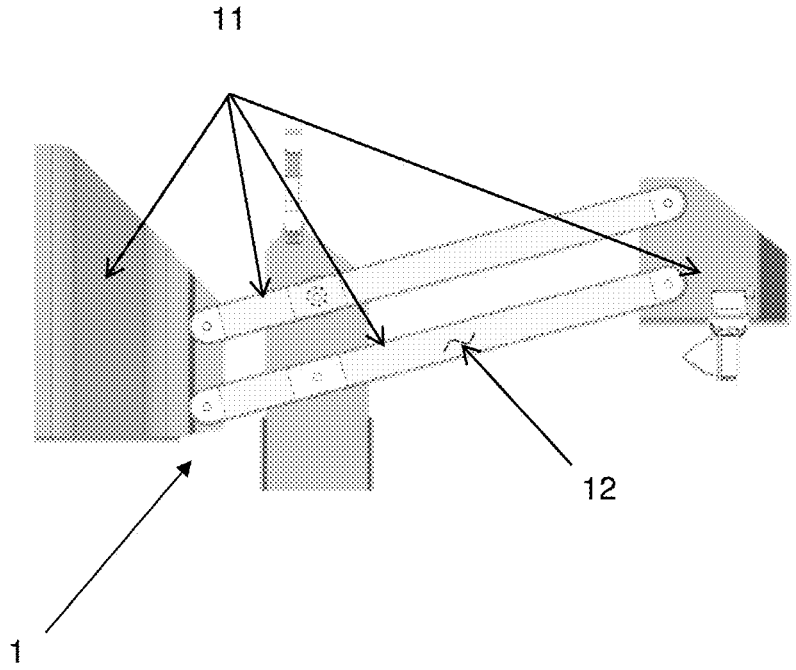
FIG. 3—schematic view of the weight reduction mechanism of the shared actuation system according to the present invention.
Figure 4:
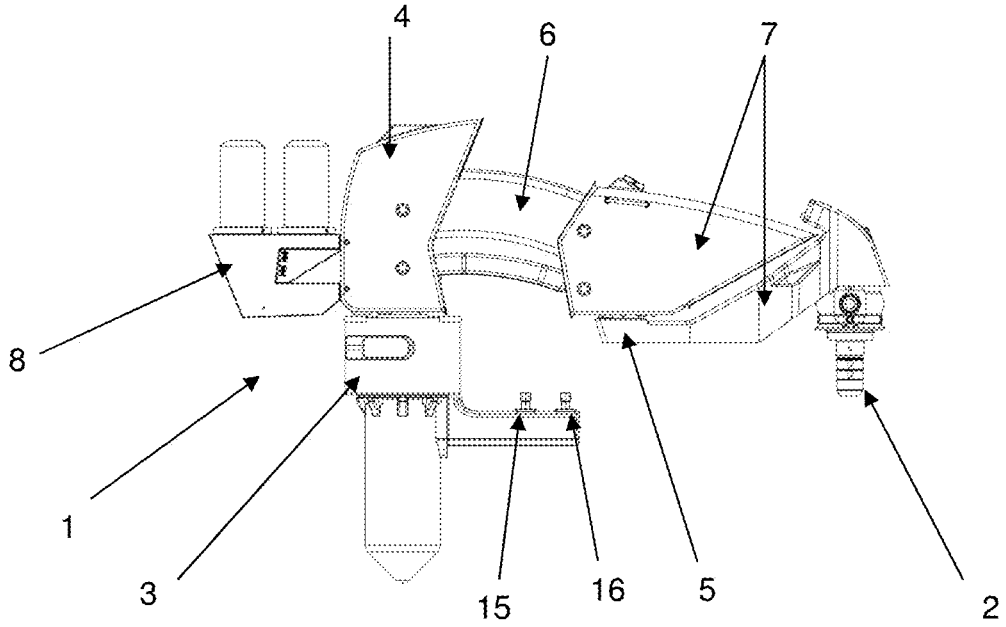
FIG. 4—a second embodiment of the shared actuation system according to the present invention.
Figure 5:
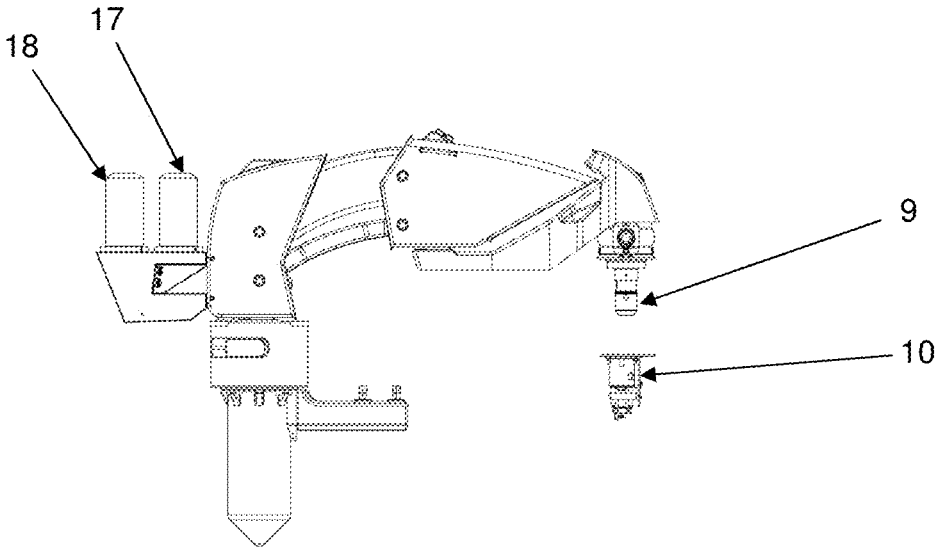
FIG. 5—schematic view of the second embodiment of the shared actuation system interface with a manifold according to the present invention.
Figure 6:
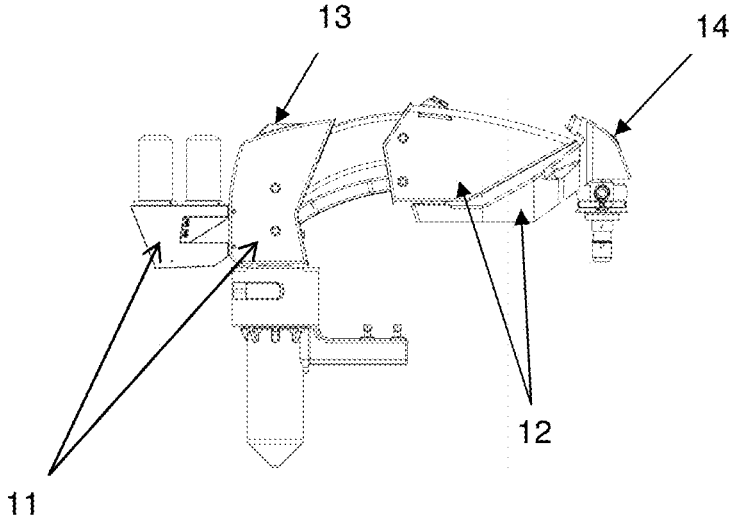
FIG. 6—schematic view of the weight reduction mechanism of the second embodiment of the shared actuation system according to the present invention.

The invention will be hereinafter described in regard to an application for a subsea structure, such as manifold subsea equipment. In FIGS. 4-6 the components are referenced by the same identification number.

In accordance with the cited Figures, the shared actuation system (1) according to the present invention comprises an actuation tool (2), which displaces through the rotary joints (3, 4, 5) and structural elements (6, 7). Said structural elements (6, 7) have a hydrodynamic profile and connect to a sail element (8), which assists the movement in the subsea environment. The hydrodynamic profile was developed to facilitate the movement inside in the subsea environment, where the forces to the movement of the arm could be minimized. The sail element (8) holds two units (17, 18—FIG. 5) (one on-line and the other one spare) which contain the electronic elements as the robotic motion unit (17) and the robotic drive unit (18) responsible for the autonomous movement of the arm. The shared actuation system articulated to move the tool according to the present invention provides features that allow it to have only one interface to attach the system unlike the Cartesian mechanism proposed by the configuration previously described for the shared actuation system of the prior art.

The interface of the manifold (20) with the shared actuation system of the present invention is performed through the contact of a single element in the actuation system and a single element in the manifold (20). In one characterization of the present invention, said element in the actuation system consists of a pin (9) and said element in the manifold (20) constitutes a funnel (10). Said feature gives the system the advantage of allowing its integration to the manifold (20) only at the end of its assembly, and also the interchangeability between systems and manifolds. Said feature is important in manufacturing situations in scale and replacement of defective units, The equipment is usually designed to be used under deep water (e.g. 1000-2000 m) for many years (e.g. 25 years), the maintenance and installation of this equipment has to be done remotely so is desired a simpler connection as it could be to install and remove the tool easily.

Furthermore, the simplification of the interface with the manifold (20) gives obvious advantages during the replacement operation of the system in the seabed by remotely operated vehicles (ROVs). Said advantage is due to the use of a single interface connection, rather than multiple ones, allowing easy installation and removal of the system. Additionally, to facilitate the replacement operation, the structural elements of the system are constructed of lightweight composite material (11), and filled with floating elements (12) so that the submerged weight of the unit is on average less than 100 kg, with this weight being the acceptable limit by most ROV operators to lift with the handlers (13 and/or 14).

FIG. 4 shows two electrical connectors (15, 16) for the ROV to be able to connect the jumpers to the subsea lines, one for the power unit and the other for the communication to the top-side unit.

Other advantages given by the articulated systems refer to the protection of the mechanisms responsible for the movement for corrosion, growth of lime and magnesium deposits due to cathode protection systems and growth of marine life. In this system, the movement is performed by means of motorized rotary joints and structural elements, which transform the rotary movement of the joints in translation of the end where the tool is operating. Thus, all components that make up the mechanism have sliding moving parts and are contained in rotary joints. Said joints are elements sealed to the external environment and offset by lubricating oil that protects the elements from the effects described above. Note that this protection is not possible or practical to be used in long-range sliding mechanisms that require rails exposed to seawater for the displacement of the mechanism, as contemplated by the prior art.

The strategy of using rotary joints for conducting the translational movements can be observed both for achieving the horizontal movement and for achieving the vertical movement, through the use of a four-bar mechanism.

Another advantage presented by the shared actuation system of the present invention consists of the minimization of the energy needed for the movement of the mechanism. Said reduction is a consequence of the hydrodynamic geometry in the structural elements of the system and the use of a structure with sail format opposite to the structural elements so that the moment imposed by marine currents acting on the system is neutralized.

In this sense, the shared actuation system object of the present invention may be advantageously applied to the execution of other tasks in addition to the valve operation, by the inclusion of appropriate tools in the structure, such as leak detection systems, cameras, sensor readers, transducers, among others. Additionally, said system can be expanded to perform tasks in other subsea equipment as Christmas trees, PLEMs (Pipeline End Manifold), PLETs (Pipeline End Termination), Subsea Separation Systems and others. Said subsea equipment is able to comprise one or more shared actuation systems of the present invention.

The invention claimed is:

1. A shared actuation system for positioning a tool relative to several valve interfaces on a subsea structure, the system comprising:

a connection device for connection to the subsea structure in one fixed position;

three sealed rotary joints;

a first structural element connected to the connection device by means of a first and a second of the three sealed rotary joints;

a second structural element connected to a distal end of the first structural element by a third of the three sealed rotary joints, providing at least two degrees of freedom for a distal end of the second structural element, the first structural element and the second structural element forming an arm extending from the connection device;

a valve actuation tool, for opening and closing valves on the subsea structure, coupled to the distal end of the second structural element such that the valve actuation tool is positioned on an opposite end of the arm from the connection device, the valve actuation tool positioned for interaction with the valve interfaces on the subsea structure; and a sail element connected to a proximal end of the first structural element in order to compensate a weight of the valve actuation tool positioned on an opposite end of the structural elements.

2. The shared actuation system according to claim 1, wherein the connection device comprises a single interface comprising a pin or funnel for interaction with complimentary elements on the subsea structure.

3. The shared actuation system according to claim 1, wherein at least a part of the structural elements is made of composite materials.

4. The shared actuation system according to claim 2, wherein the subsea structure is a manifold.

5. The shared actuation system according to claim 1, further comprising floating elements integral or attached to the system.

6. The shared actuation system according to claim 1, further comprising a control system arranged to operate the rotary joints to position the tool relative to the desired valve interface for interaction with the valve.

7. The shared actuation system according to claim 6, wherein the control system comprises a communication unit for communication with a remote located operator.

8. A subsea system comprising:

a subsea structure and a shared actuation system according to claim 1, wherein the shared actuation system is connected to the subsea structure in one fixed position, and there being a rotary joint between the connection device and the structural elements and there being at least two structural elements connected by a rotary joint, arranged such that the tool at the distal end of the structural element may be operated to interact with several valve interfaces arranged around this fixed position and at different radial distances from the fixed position.

* * * * *